United States Patent [19]

Birkle et al.

[11] 4,417,954

[45] Nov. 29, 1983

[54] ELECTROLYTE FOR THE ELECTRODEPOSITION OF ALUMINUM

[75] Inventors: Siegfried Birkle, Höchstadt; Klaus Stöger, Nuremberg, both of Fed. Rep. of Germany

[73] Assignee: Siemens Aktiengesellschaft, Munich, Fed. Rep. of Germany

[21] Appl. No.: 460,817

[22] Filed: Jan. 25, 1983

[30] Foreign Application Priority Data

Jan. 25, 1982 [DE] Fed. Rep. of Germany ..... 3202265

[51] Int. Cl.[3] ..... C25D 3/44

[52] U.S. Cl. ..... 204/14 N

[58] Field of Search ..... 204/14 N

[56] References Cited

U.S. PATENT DOCUMENTS 3,929,611 12/1975 Hess ..... 204/14 N 4,381,975 5/1983 Daenen ..... 204/14 N

FOREIGN PATENT DOCUMENTS 1047450 8/1961 Fed. Rep. of Germany ... 204/14 N

*Primary Examiner*—T. M. Tufariello

*Attorney, Agent, or Firm*—Kenyon & Kenyon

[57] ABSTRACT

An organometallic electrolyte for the electrodeposition of aluminum is described which exhibits high throwing power as well as high conductivity and good solubility and is commercially readily accessible. For this purpose, the invention provides an electrolyte of a formula based upon an organometallic complex of potassium, rubidium or cesium fluoride in combination with a series of organometallic aluminum compounds.

6 Claims, No Drawings

ELECTROLYTE FOR THE ELECTRODEPOSITION OF ALUMINUM

BACKGROUND OF THE INVENTION

The invention relates to an organometallic electrolyte for the electrodeposition of aluminum as well as to the use of this electrolyte.

For the electrodeposition of aluminum, organometallic electrolytes, i.e., organo-aluminum complex compounds can be used (see German Patent No. 1 047 450: column 9, lines 17 to 31). A number of compounds have been described which can be used for electroplating aluminum, for instance, onium and alkali-complex compounds. In practice the complex salt $NaF.2Al(C_2H_5)_3$ which is described as the most appropriate, has been used exclusively.

Electroplating baths with $NaF.2Al(C_2H_5)_3$ as the electrolyte salt, however, have a decisive disadvantage for a technically broad and economical application: the throwing power, i.e., the ability of an electroplating solution to deposit metal uniformly on an irregularly shaped cathode or surface, is too low. It is comparable to that of aqueous chromium baths. Due to the low throwing power in electrodepositing aluminum, parts having a highly irregular profile can only be plated as rack-supported articles, where the geometry of the parts allows through the use of auxiliary anodes. However, this is a technically very painstaking and therefore expensive procedure. Because of the low throwing power of aluminum electroplating baths, barrel aluminum plating of small parts is also not practical, since the aluminum plated parts exhibit excessive layer thickness variations or are not plated at all at critical points.

It is an object of the invention, therefore, to discover an organometallic electrolyte for electrodepositing aluminum which has high throwing power but shows high conductivity and good solubility, and is readily accessible commercially.

SUMMARY OF THE INVENTION

According to the invention, this is achieved by an electrolyte which has the following composition:

$$MeF.[(m-n)AlEt_3.nAlR_3], \quad (1)$$

where

Me is potassium, rubidium or cesium;

R is H or $C_xH_{2x+1}$ with x being 1 and 3 to 8, and at least two groups R being alkyl radicals;

m is 1.3 to 2.4 and n is 0.1 to 1.1, where m must be larger than 2n.

In formula (1) above, "Me" means metal and "Et" stands for an ethyl radical, i.e., for $C_2H_5$; otherwise, also different metals can be present side by side.

Preferred embodiments of the electrolyte according to the invention include those with the following composition:

$$KF.[(m'-n')AlEt_3.n'AlR'_3];$$

where m' is 1.8 to 2.2 (in particular 2.0)

n' is 0.2 to 0.5 (in particular 0.4) and

R' may be $CH_3$ or $C_4H_9$, where the radical R' may be n- or isobutyl radicals.

DETAILED DESCRIPTION OF THE INVENTION

The organo aluminum electrolyte of the invention according to formula (1 ) is highly progressive from an electroplating point of view. It meets the requirements of an electrolyte for an aluminum-plating method which is technically broadly applicable and is economical to a far higher degree than has been possible heretofore. The electrolyte according to the invention exhibits great throwing power while at the same time its electric conductivity and solubility provide for economical aluminum plating. Moreover, it is readily available commercially. It combines for the first time the electrolyte properties which are relevant for electroplating. It is a further advantage that this electrolyte has substantially less sensitivity to oxygen and moisture than $NaF.2Al(C_2H_5)_3$.

The electrolyte according to the invention is based on an understanding which was obtained with regard to the interrelations between the composition of organo-aluminum complex compounds on the one hand and the electrodeposition requirements such as throwing power, conductivity and solubility (in low-viscosity aromatic hydrocarbons with low water absorptivity, which are liquid at room temperature) on the other. These interrelations had not been known heretofore.

It has now been found that the metal ion is the governing factor for the throwing power, while the conductivity is influenced by the metal ion as well as by the halogen ion and by the length of the alkyl radicals. For the solubility, on the other hand, the alkyl radicals and the metal ion are found to be particularly relevant.

In detail, the following relationship applies. The throwing power, conductivity and ease of handling improve with increasing ion radius of the alkali metal, while an opposite effect is obtained for the halogen ion. For high conductivity, the alkyl radicals should not be sterically highly bulky and should have short chains. For achieving high solubility, small metal ions are better suited than large ones.

With the electrolyte according to the invention, a technically usable product was created for the first time. This applies especially also for the ease of handling; i.e., this electrolyte is soluble at room temperature and can be transported in a simple manner in the concentration range of the electrolyte of interest for electroplating.

In the operating range of interest for electroplating, the electrolyte according to the invention is comparable to cadmium electrolytes as far as throwing power is concerned. Thereby, this electrolyte provides for the first time power to aluminize the same spectrum of products as can be cadmiumized with cadmium-plating. Thereby, the technical requisite for electrodeposition is provided to replace cadmium with aluminum as a corrosion protection coating.

The electrolyte according to the invention is preferably employed in the form of a solution. As solvents serve in particular aromatic hydrocarbons which are liquid at room temperature such as toluene, advantageously with the following composition: 1 mol electrolyte salt for 1 to 10 mol, and preferably 1 to 5 mol of the solvent.

The invention will be illustrated in greater detail with the aid of examples.

EXAMPLES

Aluminum Electrolyte Compositions

A. Preparation of the Electrolyte

In a Witt stirring vessel (capacity, 3 liters) which was provided with a mechanical stirrer, a dripping funnel, a thermometer and an inert-gas transfer system and had a conductivity cell, was placed about 1140 ml toluene and 183.5 g potassium fluoride suspended therein. To this suspension was added by and by, while stirring, 577 g triethyl aluminum and 250 g triisobutyl aluminum. In the process was formed, while the conductivity increased and the temperature rose, the electrolyte $KF.[1.6Al(C_2H_5)_3.0.4Al(i\text{-}C_4H_9)_3].3.4$ mol toluene as a clear colorless liquid. After the reaction was completed, this electrolyte composition had, at 100° C., a conductivity of 2.25 S $cm^{-1}$.

By the same method, also electrolytes with different compositions can be prepared. In principle, also solvent-free electrolytes can likewise be prepared. However, it is necessary for this purpose to carry out the foregoing reaction without solvent and above the melting temperature of the electrolyte in question, i.e. as a neat melt.

In the following Table, the electric conductivities (in $10^{-2}S\ cm^{-1}$) at 100° C. are given for several electrolytes of the general form $KF.[(2-n)AlEt_3.nAlR_3].3.4$ mol toluene which were prepared according to the foregoing procedure by varying the mole ratios and ingredients as indicated.

TABLE 1

| | n | | | | |
|---|---|---|---|---|---|
| $AlR_3$ | 0,1 | 0,2 | 0,3 | 0,4 | 0,5 |
| $Al(n\text{-}C_4H_9)_3$ | 2,5 | 2,4 | 2,25 | 2,0 | 1,95 |
| $Al(i\text{-}C_4H_9)_3$ | 2,85 | 2,6 | 2,4 | 2,25 | 2,1 |
| $Al(i\text{-}C_4H_9)_2H$ | 2,25 | 2,0 | 1,7 | 1,5 | 1,25 |
| $Al(n\text{-}C_8H_{17})_3$ | 2,3 | 2,05 | 1,6 | 1,5 | 1,05 |
| $Al(CH_3)_3$ | 2,5 | 2,7 | 2,7 | 2,8 | 2,6 |

B. Electrodeposition Tests

Referring to electrodeposition tests, the high throwing power of the electrolyte according to the invention was demonstrated. In order to carry out the electrodeposition tests, an electroplating cell was used which had the form of a rectangular glass vessel (20 cm×8 cm×20 cm), and at each end face of which was arranged an aluminum anode sheet. Since the aluminum electrolytes are air- and moisture-sensitive, the electroplating cell was provided with a special lid which had several openings: for a thermometer, a conductivity cell, a gas transfer pipe (for flooding the cell with nitrogen), two stirrers (arranged at diagonally opposite corners of the cell in front of the anodes) and for inserting the test bodies to be aluminum plated. Rectangular angle shapes of steel of a specific size were used as test bodies. For determining the throwing power, the thickness of the aluminum layer deposited on the angle sheets was determined by means of a layer-thickness measuring device.

Prior to the aluminum plating, the individual test specimens were pretreated, as customary in electroplating, i.e., pickled and degreased. To this end, the test specimen fastened to a cathode rod was first predegreased by means of an organic solvent and pickled by immersion in diluted hydrochloric acid. Subsequently, the specimen was degreased cathodically and provided with a nickel layer about 1 micron thick to improve the adhesion. After rinsing with water and subsequent removal of the adhering water film (by means of a dehydrating agent and subsequent immersion in toluene, the specimen, still moist with toluene, was placed in the electroplating cell i.e., in the electrolyte and arranged as the cathode between the two anodes (cathode area, 200 $cm^2$; distance between the anode and the cathode, about 10 cm each). The electroplating was carried out at an electrolyte temperature of 100° C. by means of so-called pulsed current (deposition voltage, ±10 V). To this end, the specimens were poled alternatingly as the cathode and the anode, the cathodic deposition time being 80 ms and the anodic deposition time 20 ms.

Electrolytes investigated were the electrolyte according to the invention, the known electrolyte $NaF.2Al(C_2H_5)_3$, a cadmium electrolyte (with cyanide), a zinc electrolyte (weakly cyanidic) and a nickel electrolyte (weakly acid). In the case of the three last mentioned electrolytes, the electroplating took place with d-c current.

The following was found: When electroplating in the normal operating range (Al-electrolytes: 1 A/$dm^2$; cadmium, zinc, and nickel electrolyte: 2 A/$dm^2$) under otherwise similar conditions, the throwing power for the known electrolyte in the form of $NaF.2Al(C_2H_5)_3.3.4$ toluene, was only 13%, while the electrolyte according to the invention in the form $KF.[1.6Al(C_2H_5)_3.0.4Al(i-C_4H_9)_3].3.4$ mol toluene had a throwing power of about 38%, i.e., almost three times as much. In comparison thereto, the throwing power for the zinc-electrolyte is about 30%, for the nickel-electrolyte about 33% and for the cadmium electrolyte about 40%.

What is claimed is:

1. An organometallic electrolyte for the electrodeposition of aluminum, comprising: a metal fluoride composition of the formula $$MeF.[(m-n)AlEt_3.nAlR_3],$$

wherein,

Me is potassium rubidium or cesium;

R is H or $C_xH_{2x+1}$, x being an integer selected from 1 and 3 to 8, m is a number from 1.3 to 2.4 and n is a number from 0.1 to 1.1, m being larger than 2n; and at least two R groups are alkyls selected from said formula $C_xH_{2x+1}$.

2. An organometallic electrolyte according to claim 1 wherein:

x is selected from 1, 3 or 4;

m is a number from 1.8 to 2.2; and n is a number from 0.2 to 0.5.

3. An organometallic electrolyte comprising: a metal fluoride composition having the following formula:

$$KF.[(m'-n')AlEt_3.n'AlR'_3],$$

wherein, m' is a number from 1.8 to 2.2;

n' is a number from 0.2 to 0.5;

K is potassium;

Et is ethyl; and

R' is methyl or butyl.

4. An organometallic electrolyte according to claim 3 wherein m is 2.0, n is 0.4 and R is i-butyl.

5. A method for aluminum electroplating in an electroplating cell comprising using as the electrolyte, an organometallic electrolyte according to claim 1 in solution with an aromatic hydrocarbon which is liquid at ambient temperature and wherein the molar ratio of electrolyte to hydrocarbon is from about 1:1 to about 1:10.

6. A method according to claim 5 wherein the ratio is from about 1:1 to 1:5 and the hydrocarbon is toluene.

* * * * *